US012768291B1

(12) United States Patent
Lawrence et al.

(10) Patent No.: US 12,768,291 B1
(45) Date of Patent: Oct. 20, 2026

(54) BOOST ASSISTED IMPACTOR WITH COALESCED OIL PROTECTION

(71) Applicant: Caterpillar Inc., Peoria, IL (US)

(72) Inventors: Rodney Allen Lawrence, Frankfort, IN (US); Lucas K. Smith, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 19/205,755

(22) Filed: May 12, 2025

(51) Int. Cl.
*F01M 13/04* (2006.01)
*F01M 13/02* (2006.01)

(52) U.S. Cl.
CPC ..... *F01M 13/04* (2013.01); *F01M 2013/027* (2013.01); *F01M 2013/0433* (2013.01); *F01M 2013/0438* (2013.01); *F01M 2013/0488* (2013.01)

(58) Field of Classification Search
CPC ..... F01M 13/04; F01M 2013/027; F01M 2013/0433; F01M 2013/0438; F01M 2013/0488
USPC ..... 123/572
See application file for complete search history.

(56) References Cited

U.S. PATENT DOCUMENTS

| | | | | |
|---|---|---|---|---|
| 6,520,164 | B1 | 2/2003 | Lepp et al. | |
| 6,647,973 | B1 | 11/2003 | Schueler et al. | |
| 7,080,637 | B2 | 7/2006 | Choi | |
| 7,506,629 | B2 | 3/2009 | Kawamura et al. | |
| 7,849,841 | B2 * | 12/2010 | Holzmann | F01M 13/04 123/41.86 |
| 9,545,591 | B2 * | 1/2017 | Parikh | B01D 46/2403 |
| 9,909,470 | B2 * | 3/2018 | Christian | F01M 13/0416 |
| 11,828,213 | B2 | 11/2023 | Zhao et al. | |
| 12,071,871 | B1 * | 8/2024 | Smith | F01M 13/0033 |
| 2003/0000508 | A1 * | 1/2003 | Takahashi | F02M 35/10222 123/572 |
| 2014/0076294 | A1 * | 3/2014 | Ulrey | F01M 13/022 123/572 |
| 2017/0241309 | A1 | 8/2017 | Coolens et al. | |

* cited by examiner

*Primary Examiner* — Hai H Huynh

(57) ABSTRACT

An oil discharge system may include an oil collection trough, a boost air supply line, a nozzle in fluid communication with the boost air supply line, a discharge tube configured to receive boost air from the nozzle the increased velocity, and a siphon tube having an open end arranged in the oil collection trough and another end in fluid communication with the discharge tube. The boost air in the discharge tube at the increased velocity may draw oil out of the collection trough, through the siphon tube, and into the discharge tube. The discharge tube may isolate the oil from exposure to blow-by air flow within the boost assist impactor and carries the oil from the oil collection trough to a discharge point at or near an oil outlet of the boost assist impactor.

20 Claims, 4 Drawing Sheets

BOOST ASSISTED IMPACTOR WITH COALESCED OIL PROTECTION

TECHNICAL FIELD

The present disclosure relates to elements of a crankcase ventilation system. More particularly, the application pertains to oil separation components of a crankcase ventilation system. Still more particularly, the application relates to a boost assist impactor system used to separate oil in the crankcase ventilation system.

BACKGROUND

Reciprocating engines can generate blow-by gases that collect in the crankcase. Blow-by gases can be generated at the piston-ring liner, at the turbocharger, and/or at the valve train system. Blow-by gases may be ventilated from the crankcase to avoid excessive pressure build up, to reduce or minimize oil contamination, and for other reasons. In some systems, the blow-by gases may be vented to the surrounding atmosphere. In other systems, the blow-by gases may be routed back to the engine and reused in engine combustion processes.

In some cases, blow-by gases may be filtered to remove liquid oil, oil aerosol, and airborne particulates such as ash, soot, and other particulate matter. In one or more examples, a boost assist impactor may be provided. However, boost assist impactors may include a variable geometry impactor that exposes coalesced oil to air flows that risk re-entrainment of the oil into the airflow.

SUMMARY

In one or more examples, a boost assist impactor for a crankcase ventilation system may be provided. The boost assist impactor may include a blow-by air inlet. The boost assist impactor may also include an oil separation device including at least one of a variable geometry impactor or a filter media. The oil separation device may be in fluid communication with the blow-by air inlet to receive blow by air and configured to process the blow-by air to separate oil from the blow-by air. The boost assist impactor may also include an oil collection trough configured to collect oil from the oil separation device, a boost air supply line configured for receiving boost air from a turbo boost system of an engine, a nozzle in fluid communication with the boost air supply line and configured to increase the velocity of the boost air received from the boost air supply line, a discharge tube configured to receive boost air from the nozzle at the increased velocity, and a siphon tube having an open end arranged in the oil collection trough and another end in fluid communication with the discharge tube such that the boost air in the discharge tube at the increased velocity draws oil out of the collection trough, through the siphon tube, and into the discharge tube. The discharge tube may carry the oil from the oil collection trough to an oil outlet of the boost assist impactor while being fully closed off to exposure to blow-by air flow within the boost assist impactor.

In one or more other examples, an oil discharge system for a boost assist impactor may include an oil collection trough arranged about a variable geometry impactor or a media filter of the boost assist impactor. The oil discharge system may also include a boost air supply line configured for receiving boost air from a turbo boost system of an engine. The oil discharge system may also include a nozzle in fluid communication with the boost air supply line and configured to increase the velocity of the boost air received from the boost air supply line. The oil discharge system may also include a discharge tube configured to receive boost air from the nozzle at the increased velocity. The oil discharge system may also include a siphon tube having an open end arranged in the oil collection trough and another end in fluid communication with the discharge tube such that the boost air in the discharge tube at the increased velocity draws oil out of the collection trough, through the siphon tube, and into the discharge tube. The discharge tube may isolate the oil from exposure to blow-by air flow within the boost assist impactor and carry the oil from the oil collection trough to a discharge point at or near an oil outlet of the boost assist impactor.

DETAILED DESCRIPTION

Figure 1:
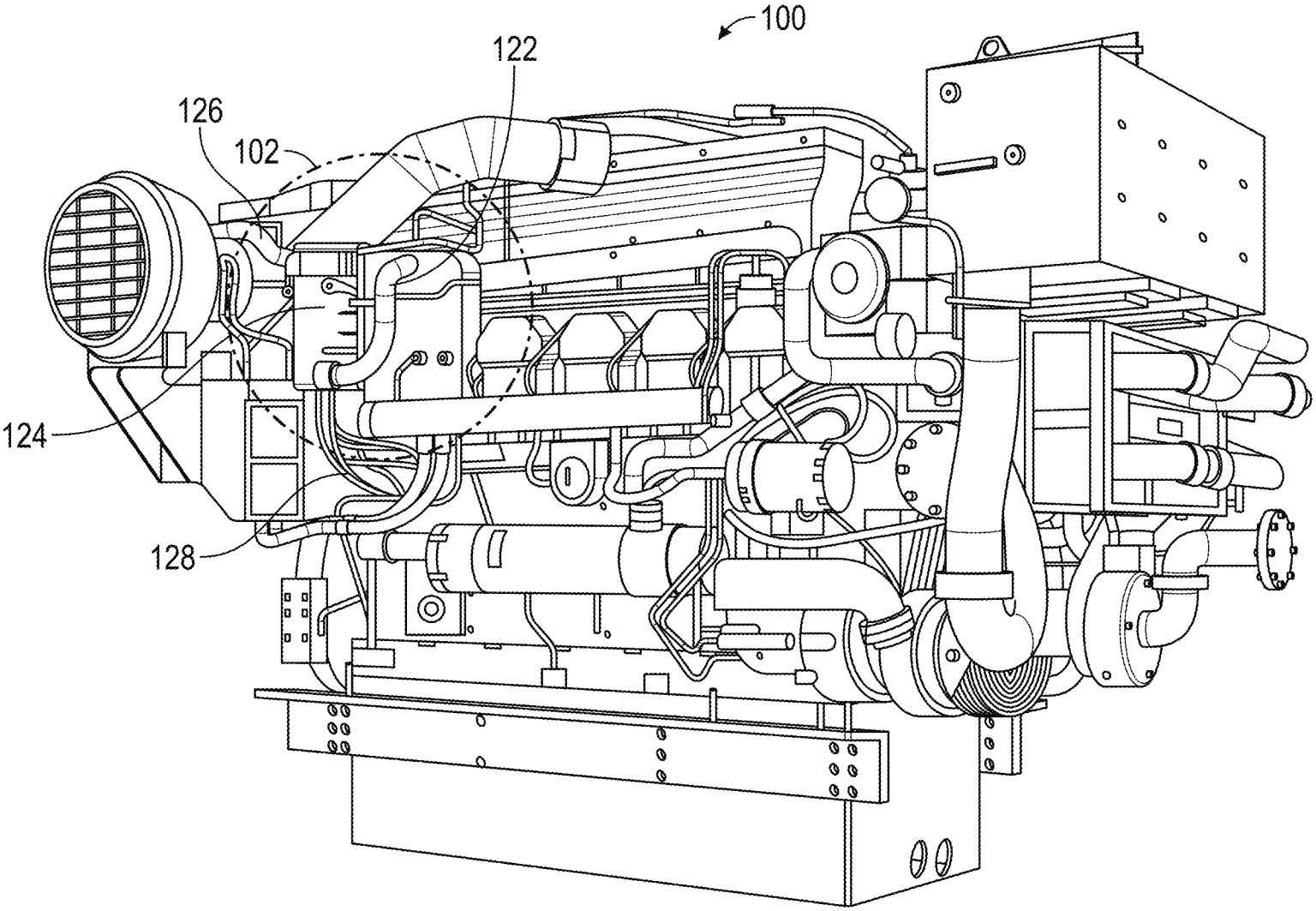
FIG. 1 is a perspective view of a reciprocating engine with a crankcase ventilation system including a boost assist impactor, according to one or more examples.
Figure 2:
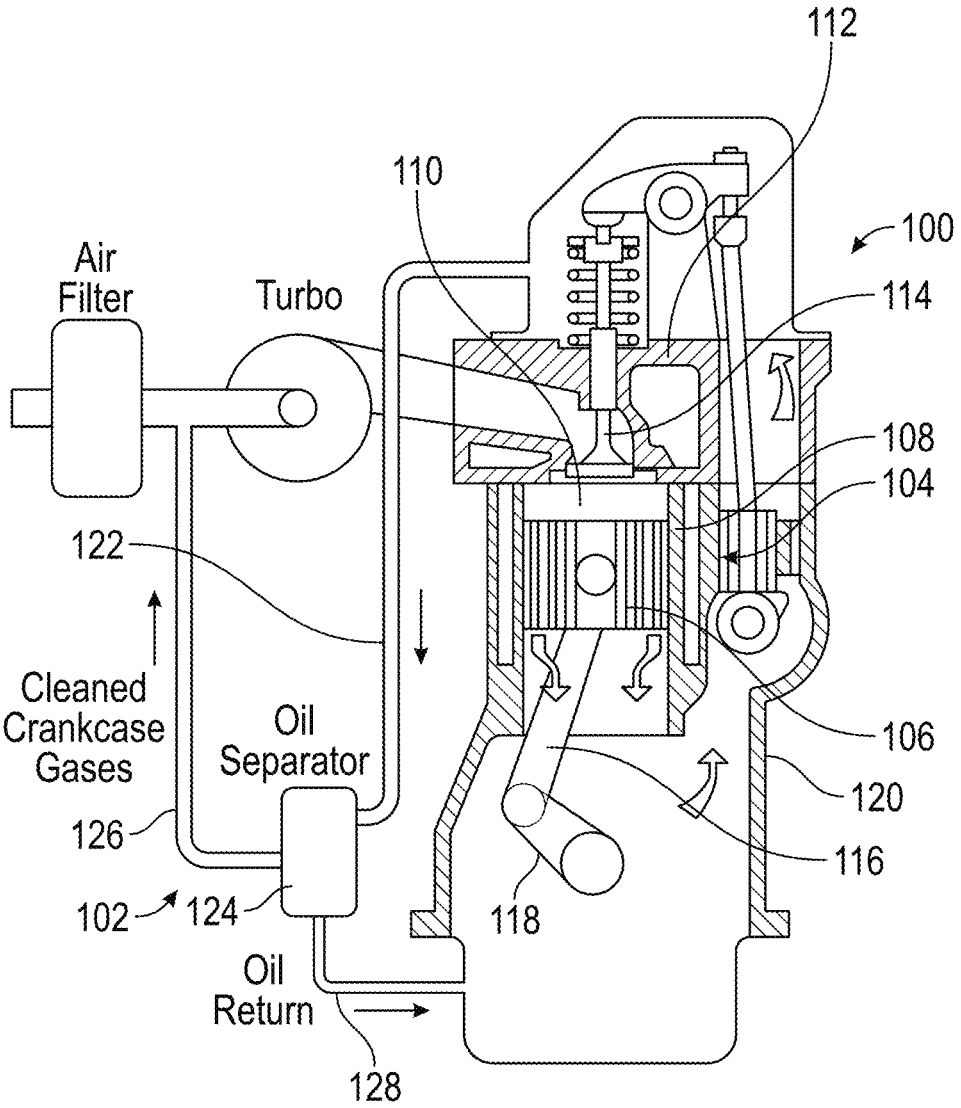
FIG. 2 is schematic cross-sectional view of the crankcase ventilation system of FIG. 1 and including the boost assist impactor, according to one or more examples.

FIG. 1 shows a reciprocating engine 100 equipped with a crankcase ventilation system 102 and FIG. 2 shows a cross-sectional schematic diagram of a reciprocating engine 100 with a crankcase ventilation system 102. The reciprocating engine 100 may include a plurality of cylinders 104 including respective pistons 106 configured to move up and down within the cylinders 104. The cylinders 104 may include a cylinder wall 108 and, together with the piston 106, may define a combustion chamber 110. The pistons 106 may be driven by the combustion of fuel, which generates mechanical energy to power the engine 100. A cylinder head 112 may be positioned at the top of the engine cylinders 104, sealing the chamber 110 and housing components such as an inlet valve 114 and an exhaust valve (not shown). The inlet valve 114 may provide for the flow of air into the combustion chamber 110 and the exhaust valve may facilitate the expulsion of combustion byproducts. A piston rod 116 may connect the piston 106 to the crankshaft 118 converting the reciprocating motion of the piston 106 into rotational motion, which drives the engine's output shaft and powers associated equipment. The reciprocating engine 100 may be used in conjunction with a wide variety of equipment including work machines, power generators, waterborne vessels, and other types of equipment and may be used as a source of motive power, electrical generation, hydraulic power, or other types of power.

As shown in FIG. 2, the crankshaft 118 may be arranged in a crankcase 120. The crankcase 120 may be arranged below the cylinders 104 of the engine 100 and may also extend upward around the engine to the top side of the engine where, for example, the valve train system is located.

As shown by the arrows below the piston, blow-by gases may leak passed the piston 106 during combustion and enter the crankcase 120. Additional gases may enter the crankcase 120 from the valve train system and/or from the turbocharger.

As shown in FIGS. 1 and 2, a crankcase ventilation system 102 may be provided. The crankcase ventilation system 102 may be configured to relieve the crankcase of blow-by gases, treat the blow-by gases and reintroduce the gases into the engine. It is to be appreciated that some systems may exhaust the blow-by gases to the environment rather than reintroducing them into the engine and the details of the present disclosure are equally applicable to these types of systems as well. As shown in FIGS. 1 and 2, the crankcase ventilation system 102 may include a blow-by gas inlet line 122, a separator 124, an air return line 126, and an oil return line 128.

The inlet line 122 may be fluidly coupled to the valve cover or other aspect of the crankcase 120 and may extend to and be fluidly coupled with an inlet of the separator 124. The inlet line 122 may receive blow-by gases from the crankcase 120 and deliver the blow-by gases to the separator 124. The air return line 126 may be fluidly coupled to an air outlet of the separator 124 and may extend to and be fluidly coupled with the air intake of the engine 100. In one or more examples, the air return line 126 may be fluidly coupled to the air intake of the engine between the air filter and the turbocharger. The air return line 126 may, thus, receive cleaned air from the separator 124 and carry it to the intake to re-introduce the gas into the combustion stream of the engine 100. The oil return line 128 may be fluidly coupled to an oil outlet of the oil separator 124 and may extend to, and be fluidly coupled with, the crankcase 120. The oil return line 128 may, thus, receive oil that has been removed from the blow-by gases and carry it back to the crankcase 120 for further use in engine lubrication. While not show in FIG. 2, the crankcase ventilation system 102 may also include a boost air line that delivers boost air to the separator 124.

Figure 3B:
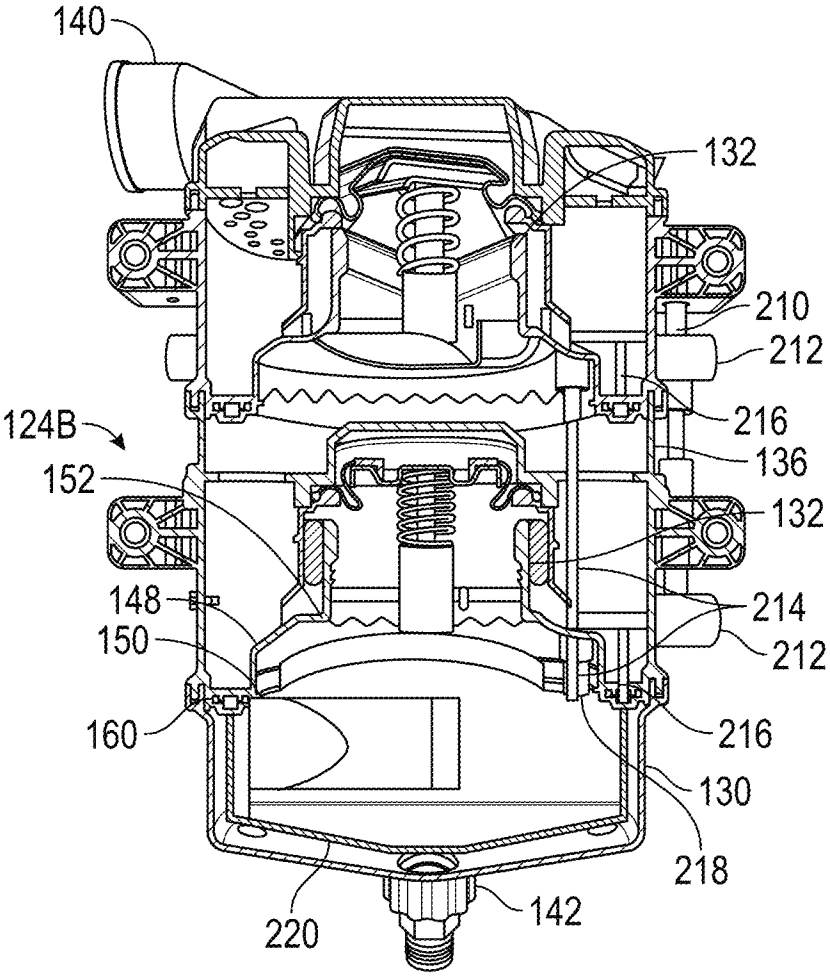
FIG. 3B is a cross-sectional view of another boost assist impactor useable with the system shown in FIGS. 1 and 2 and also including a variable geometry impactor, according to one or more examples.
Figure 3A:
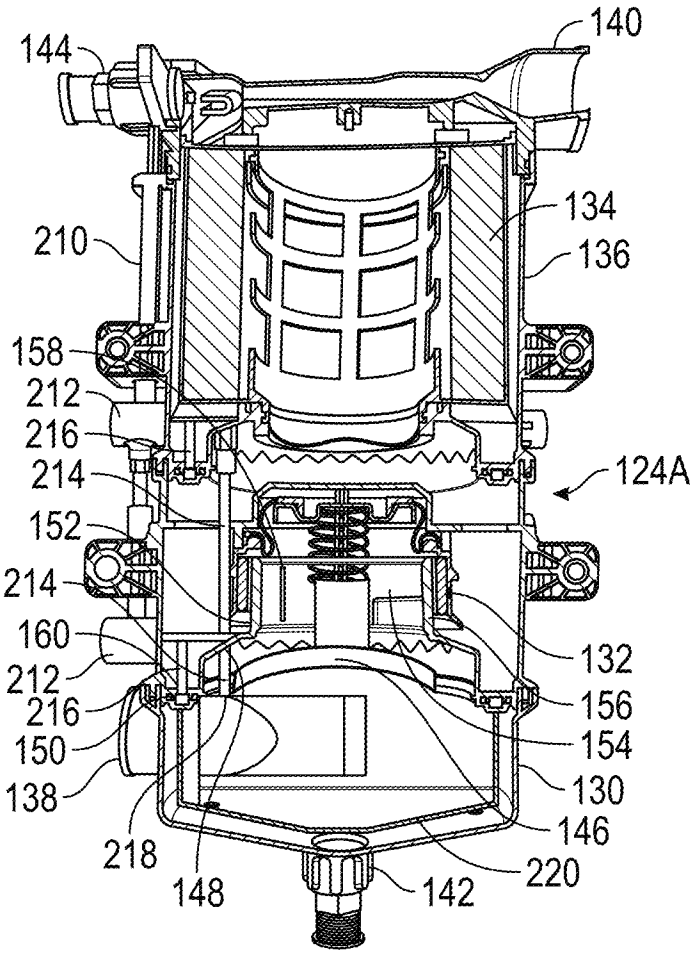
FIG. 3A is a cross-sectional view of the boost assist impactor of FIGS. 1 and 2 including a variable geometry impactor, according to one or more examples.

Turning now to FIGS. 3A and 3B, two types of oil separators 124 are shown. FIG. 3A shows a boost assist impactor with a media filter 124A and FIG. 3B shows a boost assist dual stage impactor 124B. Both types of separators 124 may be configured to separate oil from the blow-by gas in multiple ways. First, each boost assist impactor 124A/B may include a cyclonic entry chamber 130 that generates a cyclonic flow of the air forcing liquid toward an outside wall where it falls out of suspension and drains down the walls of the chamber 130. Second, each boost assist impactor 124A/B may include a variable geometry impactor 132 that generates a high-velocity blow-by air stream and causes it to impact a media ring. In the case of a separator 124A according to FIG. 3A, the blow-by air may further pass through a media filter 134. In the case of a separator 124B according to FIG. 3B, the blow-by air may pass through a second variable geometry impactor 132.

Figure 3C:
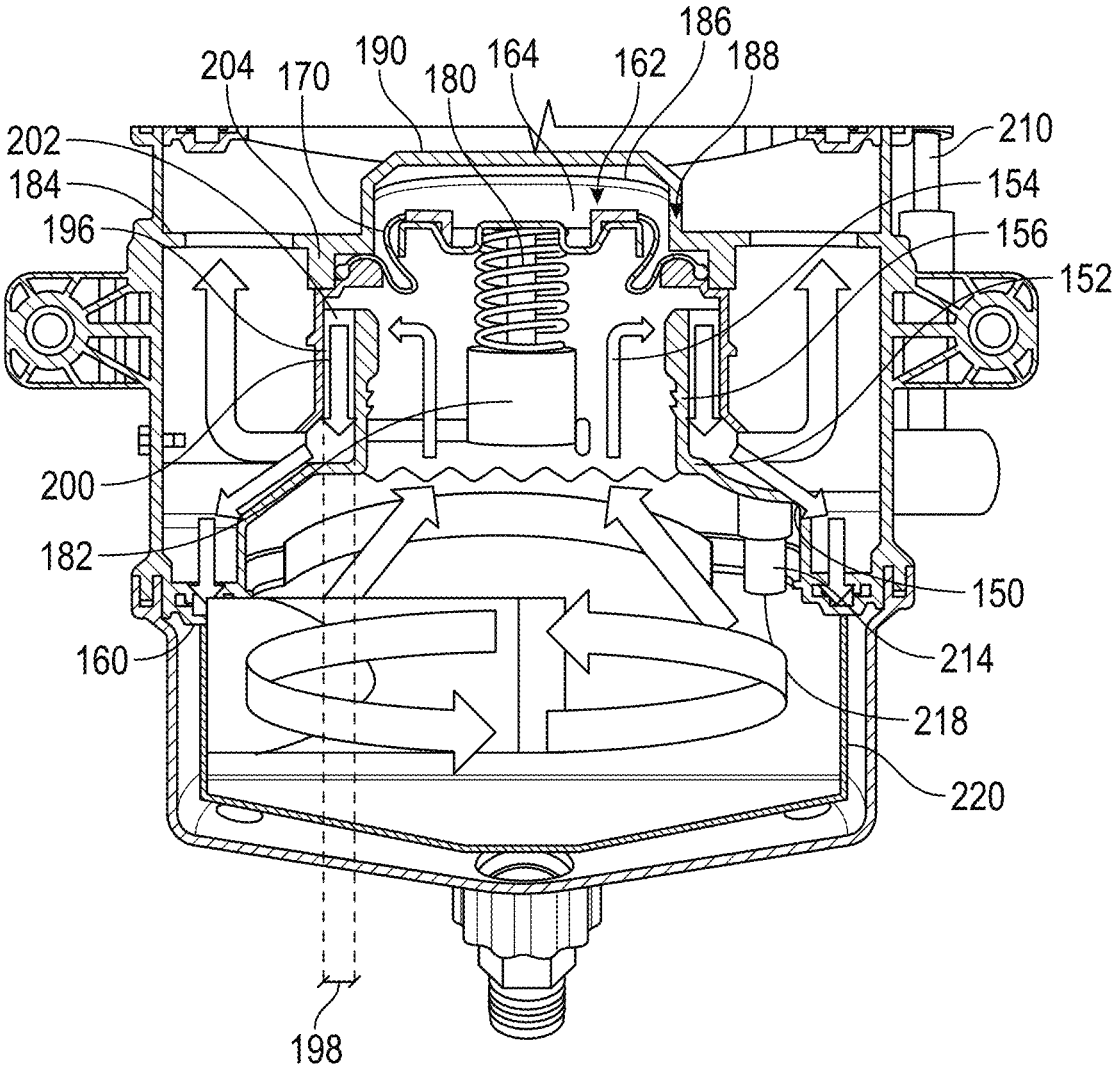
FIG. 3C is a close-up view of the variable geometry impactor of FIG. 3A and depicting air and oil flows therein, according to one or more examples.

Both of the boost assist impactors (BAI) 124A/B may include a housing 136 having an outer wall defining an internal cavity and having several ports that provide fluid communication from outside of the BAI 124A/B to the internal cavity. In one or more examples, the outer wall may be generally cylindrical or other shapes may be provided. Regarding the ports, the housing 136 may define a blow-by air inlet port 138 (see FIG. 3A) and a blow-by air outlet port 140. In addition, the housing 136 may define an oil outlet port 142. Still further, the housing may also define a boost air inlet port 144. The internal cavity may be separated into a series of distinct chambers for the several distinct operations. As mentioned, a first chamber may include a cyclonic chamber 130. Here, the housing 136 may have a generally cylindrical inner surface and the blow-by air inlet port 138 may be arranged to direct the blow-by air generally tangential to the inner surface. That is, for example, the centerline of the inlet 138 may be offset from the inner surface of the cyclonic chamber 130 by approximately ½ of the diameter of the inlet 138 such that a wall of the inlet 138 may be aligned with the inner surface of the cyclonic chamber 130 in tangential fashion allowing the air to be guided along the inner surface and around the cyclonic chamber 130 as shown in FIG. 3C. The cyclonic chamber 130 may include a generally open top allowing the blow-by air to be drawn up into a variable geometry impactor 132 as also shown in FIG. 3C. The cyclonic chamber 130 may also include a generally conical bottom configured to direct oil collected in the chamber to a centrally located oil outlet 142.

With continued reference to FIGS. 3A-3C, the variable geometry impactor (VGI) 132 may be arranged above the cyclonic chamber 130 and may be configured to generate a high-velocity stream of the blow-by air and direct it to a media ring where the impact of the high-velocity blow-by air with the media ring may cause aerosol oil, oil droplets or free oil, or other matter carried by the air to be deposited on the media ring. The VGI 132 may include an intake area 146 defined by generally dome-shaped or conically shaped baffle 148. The baffle 148 may define an intake area 146 in the form of a funnel extending upward from the cyclonic chamber 130. The baffle 148 may define a relatively large cross-sectional area of the intake funnel at its bottom edge 150 near the cyclonic chamber 130 and may define a smaller cross-sectional area of the intake funnel further upward from the cyclonic chamber 130 at its upper edge 152. The baffle 148 may give way to a generally cylindrical upward extending chute 154 arranged above the intake funnel. The chute 154 may be defined by a generally cylindrical chute wall 156 extending upward from a top edge 152 of the baffle 148 to a free top edge. The chute wall 156 may include openings, slits, or other orifices 158 that allow air to pass through the chute wall 156. In one or more examples, the orifices 158 may be arranged in an upper portion of the chute wall 156. In one particular example, the orifices 158 may include vertically extending slits arranged in an upper portion of the chute wall 156. In one or more examples, a surrounding channel 160 may be provided between the outer wall of the housing 136 and the bottom edge 150 of the dome-shaped baffle 148. The surrounding channel 160 may include a U-shaped cross-section oriented with its open end facing upward and forming an oil collection trough extending about the perimeter of the baffle 148 within the outer wall of the housing 136. A bottom side of the surrounding channel 160, the dome-shaped baffle 148, and the chute 154 may all collectively function to receive blow-by air from cyclonic chamber 130 and guide the air upward and into the chute 154.

One or more or all of the dome-shaped baffle 148, the chute 154, and the surrounding channel 160 may be generally concentrically arranged within the housing 136. These components may also be formed as part of the housing 136. Alternatively, separate components may be used and arranged within the housing 136. These items may be generally stationary components arranged within the housing 136 and forming a framework for the VGI 132.

With particular reference to FIG. 3C, the VGI 132 may also include a reciprocating piston 162 that reciprocates near a top portion of the chute 154. The piston 162 may be configured to reciprocate to move a flexible diaphragm that controls the amount of exposure of the orifices 158 in the top portion of the chute wall 156 to the blow-by air passing through the VGI 132. The piston 162 may include a generally circular cap having an outer diameter that is the same or similar to an inner diameter of the chute wall 156. In one or more examples, the cap 164 may have a corrugated cross-section as shown, which may strengthen the cap 164 and/or provide for seating of a backer cap for securing a flexible membrane 170 to the piston cap 164. In some cases, the cap 164 may include a central hole for receiving a guide pin from above. The cap 164 may include a pin-receiving cylinder that depends downward from the central hole and includes a bottom. The bottom of the pin-receiving cylinder may function as a stop against upward movement of the piston 162 when the guide pin is fully received in the pin-receiving cylinder. Alternatively, or additionally, other stop mechanisms for controlling the upward movement of the piston 162 may be provided. While circular shapes (e.g., cylindrical chute and circular/cylindrical piston) have been described, other cross-sectional shapes may be provided where the piston geometry cooperates with the chute geometry. (e.g., square, polygonal, elliptical, or other shapes).

In one or more examples, a biasing mechanism 180 may be provided that acts on the piston 162 and biases the piston 162 in an upward direction. For example, as shown in FIGS. 3A-3C, the biasing mechanism 180 may include a framework 182 that extends inward from the chute wall 156 to support a central base. The framework 182 may include a lattice-type or other open framework adapted to support the central base, but avoid inhibiting air flow through the chute 154. A biasing mechanism 180 such as a spring may be arranged on the base and may extend upward to contact a bottom side of the piston cap 164. In one or more examples, the spring may be sized to receive the pin-receiving cylinder extending downward from a bottom side of the piston cap 164. The base may be arranged, and the spring may have a length, such that downward motion of the piston 162 is allowed when the spring force is overcome and for a selected distance before, or when, the pin-receiving cylinder on the bottom of the piston cap 164 encounters the central base. In one or more examples, the range of motion or stroke of the piston 162 may be from a top position where the flexible diaphragm 170 fully exposes the orifices 158 in the top portion of the chute wall 156 to a bottom position where the flexible diaphragm 170 fully occludes the orifices 158 in the top portion of the chute wall 156.

With continued reference to FIGS. 3A-3C, a VGI diaphragm system may also be provided. The diaphragm system may be adapted to establish a pressure differential acting on the piston 162. In particular, the diaphragm system may be configured to expose a top side of the piston 162 to ambient air pressure while the bottom side is exposed to the air pressure within the BAI. In one or more examples, the diaphragm system may include a diaphragm deck 184 extending across the BAI from the housing 136 on one side of the VGI to the housing on the other side. The deck 184 may be arranged generally above the chute/piston and may include openings near an outer peripheral portion to allow air flow through the deck 184. The deck 184 may include a pressure pocket 186 adapted to receive a portion of the piston 162 when it is at or near an upper end of its stroke. In one or more examples, the pocket 186 may be defined by a cylindrical pocket wall 188 similar in diameter or other crossing dimension to the chute 154. The cylindrical pocket wall 188 may depend upward from the deck 184 and may define a piston opening in the deck 184. The pocket 186 may be defined on an upper end by a cover plate 190. A flexible diaphragm 170 may be sealingly coupled to the deck 184 around a perimeter of the piston opening on a bottom side of the deck 184 and extending across the piston opening to close off a bottom side of the pocket 186. The diaphragm 170 may be a generally loose diaphragm, and it may extend between the pocket 186 and the piston cap 164. The cover plate 190, the cylindrical pocket wall 188, and the flexible diaphragm 170 may define a pressure chamber above the piston 162. In one or more examples, the pressure chamber may be in fluid communication with ambient air outside of the housing 136 by way of an orifice in the cylindrical pocket wall 188 and a lumen extending to an outside surface of the housing 136.

In addition to helping to establish a pressure pocket, the flexible diaphragm 170 of the diaphragm system may also function to control the amount of area of orifices in the chute wall 156 that are available for airflow through the VGI. That is, the diaphragm 170 may be secured at its outer peripheral edge to a bottom side of the deck 184. Inward from the peripheral edge, the diaphragm may include a downward extending fold that extends down inside the chute 154 before returning back upward and across the top side of the piston cap 164. As the piston 162 reciprocates up and down, the fold location may propagate up/down causing the diaphragm 170 to move with the piston 162 and adjust an amount of the flexible diaphragm 170 that interferes with or covers the orifices 158 in the chute wall 156. As such, the motion of the piston 162 may cause the flexible diaphragm 170 to move relative to the orifices 158 in the chute wall 156 to control the amount of area available for air flow through the VGI 132.

It is to be appreciated that the diaphragm 170 may be continuous across the piston opening or it may have a central opening closed off by the piston cap 164. That is, the diaphragm 170 may include a central opening defining an inner rim, and the diaphragm 170 may be adhered to a top surface of the piston cap 164. Alternatively, or additionally, a backer cap may be provided that sandwiches an inner rim of the diaphragm 170 between the backer cap and the piston cap 164. In either case, the pressure chamber may be sealed off on a bottom side thereof by the diaphragm 170 and the piston cap 164 in conjunction with one another.

An impact skirt 196 may extend downward from the deck 184 around an outside of the chute 154. The impact skirt 196 may be a generally cylindrical element having a diameter or other crossing dimension greater than the chute 154 and providing a gap 198 between an inside surface of the skirt 196 and an outside surface of the chute 154. The diameter of the skirt 196 may be selected to establish a gap size for receiving an impact media 200 while maintaining an airflow pathway 202 between the impact media 200 and the outside surface of the chute 154. Accordingly, as air exits the chute through the orifices 158 near the top thereof, the air may enter the gap 198 and impact the impact media 200 before returning downward through the airflow pathway and out a bottom of the skirt 196 where it may diffuse outward and return upward through the deck 184 of the diaphragm system. As shown by the arrows in FIG. 3C, oil being removed from the air flow through impact with the impact media 200 may coalesce on the impact media 200 and flow downward off of the impact media 200 onto a top side of the dome-shaped baffle 148 toward and into the surrounding channel 160.

In one or more examples, the impact skirt 196 may be an element of the diaphragm deck 184. For example, it may depend from a bottom side of the deck 184 and be a component of the deck 184. In other examples, the deck 184 may include a receiving rim 204 on a bottom side thereof for force fitting, welding, or otherwise securing the impact skirt 196 to or within the receiving rim 204. In one or more examples, the impact skirt 196 may be press fit or force fit within the receiving rim 204 and a peripheral edge of the flexible diaphragm 170 may be arranged within it to secure the diaphragm 170 to the deck 184. Still other approaches to securing the impact skirt 196 and the flexible diaphragm 170 may be provided.

In the case of the BAI of FIG. 3A, the air flowing upward through the deck 184 of the diaphragm system may be routed through filter media 134 before it exits the BAI. In the case of the BAI of FIG. 3B, the air flowing upward through the deck 184 of the diaphragm system may be routed into an intake funnel of a second VGI 132 where the impact process is repeated. In either case, the air passing through the filter media 134 of the BAI of FIG. 3A or the passing through the second VGI 132 of the BAI of FIG. 3B may enter the exit stream and exit the BAI at the air outlet 140 where it may be discharged out of the engine or re-introduced into the intake of the engine for further combustion.

The BAI 124A of FIG. 3A and the BAI 124B of FIG. 3B may both function based on differential air pressure that causes the exhaust gases to be drawn into the BAI air inlet 138, treated, and discharged through the BAI air outlet 140. In one or more examples, the boost air inlet 144 may receive boost air from the turbo charger at a pressure above atmospheric pressure. The boost air may be directed through a converging nozzle to generate a high velocity air flow across and within a top portion of the BAI 124. This may create a venturi effect that functions to offset pressure losses associated with air flow through the VGI 132 and the filter media 134 (FIG. 3A) or the second VGI 132 (FIG. 3B).

The functionality of the VGI's 132 within the BAI's 124 may be dependent on the air pressure within the BAI's 124 and the spring constant. In one or more examples, the spring constant may be selected to offset the weight of the piston 162 and the flexible diaphragm 170 and generally resist downward motion of the piston. As such, when the engine is not running, the piston 162 may be lifted to the top of its stroke in an "at rest" or top position. During operation, boost air received at the boost air inlet 144 may flow through a nozzle to increase its velocity creating a reduction in pressure within the BAI. This reduction in pressure may draw the piston 162 downward against the spring force causing the skirt 166 of the piston 162 to seal off a larger amount of area of the orifices 158 in the top portion of the chute 154. The control of the piston location based on a balance between the internal BAI pressure and the spring force may provide for control over the impactor open orifice area, which can help to provide suitable oil separation efficiency under a wide variety of engine conditions.

The VGI 132 may function to draw blow-by air into a bottom thereof via the intake funnel and upward into the chute 154. The relatively small orifice area in the chute wall 156, which may be controlled by how much of the flexible diaphragm 170 is covering the orifices, may create a relatively fast flowing or high-speed jet of air through the orifices 158 that impacts the impact media 200 on the impact skirt 196 thereby removing oil, oil aerosol, soot, ash, and other items not already removed in the cyclonic chamber 130 from the air flow. The air may then pass along the surface of the impact media downward and radially outward under the bottom of the impact skirt 196, where it returns upward through the diaphragm deck 184 and onto the media filter 134 (FIG. 3A) or another VGI 132 (FIG. 3B). As shown, in FIG. 3C, the oil may flow off of the impact media 200, down onto the domed baffled 148 of the VGI 132 and into the surrounding channel 160. Where the BAI includes a media filter 134 as shown in FIG. 3A, a baffle and a similar surrounding channel 160 may be provided near a bottom of the media filter 134 where oil flows off of the media filter 134 onto the baffle 148 and down into the surrounding channel 160. Where the BAI includes a second VGI 132 as shown in FIG. 3B, the baffle 148 and surrounding channel 160 of the second VGI 132 may collect oil in the same manner as the initial VGI 132. In both cases, the BAI may, thus, collect oil in an upper and a lower surrounding channel 160.

For purposes of discharging the oil collected in the one or more channels, the BAI may include an oil ejection system. In one or more examples, the oil ejection system may include a boost assisted siphon system. As shown in FIGS. 3A and 3B, the siphon system may include a boost air supply line 210 that is fluidly coupled to the boost air inlet 144. The boost air supply line 210 may extend from the boost air inlet 144 downward along the BAI. In one or more examples, the boost air supply line 210 may be arranged outside of the housing 136 as shown. However, a boost air supply line 210 could alternatively or additionally be incorporated in the housing 136 or be arranged within the housing 136. At or near each of the surrounding troughs 160, the boost air supply line 210 may provide boost air to a siphoning nozzle 212. The nozzle 212 may include a flow restriction that increases the velocity of the boost air to reduce the pressure of the flowing boost air. Each of the nozzles 212 may direct the air to a discharge tube 214. A siphon tube 216 may be arranged with a bottom open end in the trough 160 and an upper end fluidly coupled to discharge tube 214. As such, the high velocity boost air in the discharge tube 214 may draw the oil from the trough 160 upward through the siphon tube 216 and into the discharge tube 214. The discharge tube 214 may extend downward through the baffle 148 below the respective VGI or media filter 134 and may extend downward to a release point 218 within the cyclonic chamber 130. That is, the discharge tube 214 may be a closed tube that extends through and/or across blow-by airflows thereby protecting the coalesced and collected oil from exposure to the blow-by airflow to reduce the risk of re-entrainment of the oil into the blow-by air.

The upper discharge tube 214 may be offset from a lower discharge tube 214 in a circumferential direction about the BAI. That is, while the upper discharge tube 214 is shown to align with the lower discharge tube 214 in FIGS. 3A-3C, the tubes may be offset about the circumference of the BAI. This may allow for maintaining the discharge of the upper and lower channels 160 separate from one another and avoid interference of the upper discharge tube 214 with the lower discharge tube 214. This may also help to avoid releasing the oil from upper discharge tube 214 in a location where it may be subject to air flows and potential re-entrainment. That is, for example, were the upper discharge tube 214 to dump the oil onto the lower baffle 148 or even directly into the lower channel 160, this may subject the oil to the airflows of the lower VGI 132. By offsetting the discharge tubes 214, the upper discharge tube 214 and the lower discharge tube 214 may remain fully closed from the point of oil collection to the discharge point 218 of the oil at the cyclonic chamber 130. Another approach to maintaining closed fluid flows would be to provide concentrically arranged discharge tubes 214 where the upper discharge tube is arranged inside the lower discharge tube. For example, the upper discharge tube may penetrate the lower discharge tube at a seal and extend through the lower discharge tube. Still other approaches may include penetrating the lower discharge tube with the upper discharge tube at a seal and releasing the oil from the upper system into the discharge tube of the lower system. Still other approaches to maintaining a discharge system that is isolated and/or protected from exposure to blow-by air flow within the BAI may be provided.

As the discharge tubes extend toward the bottom of the BAI, they may enter the cyclonic chamber at a discharge point 218. In one or more examples, the discharge tubes 214 may have an open bottom just as they enter the cyclonic chamber 130. For purposes of protecting the oil from exposure to incoming blow-by air in the cyclonic chamber, a chamber liner or jacket 220 may be provided. For example, as shown in FIGS. 3A-3C, a liner 220 may be provided within the cyclonic chamber 130 that creates a passage way outside the jacket 220 and within the cyclonic chamber 130 that protects the oil against re-entrainment by the incoming blow-by air. The jacket 220 may include an opening in a wall thereof at or near the blow-by air inlet to allow the incoming air to enter the chamber 130 and be received within the jacket 220 where the cyclonic action may take place. As such, the oil delivered to the cyclonic chamber 130 may flow along the outside wall of the cyclonic chamber and down along a conical bottom of the cyclonic chamber to the oil outlet.

The above system may, thus, include a fully isolated oil discharge system for the BAI. The fully isolate system may draw oil out of the channel 160 surrounding the upper and lower VGI (FIG. 3B) or the channel 160 surrounding the media filter and the lower VGI (FIG. 3A). The fully isolated system may maintain the oil in a fully protected condition against exposure to surrounding blow-by airflows and may be in fluid communication with the oil discharge point at the cyclonic chamber. In one or more examples, each channel 160 may include a dedicated discharge system leading to the cyclonic chamber 130 where the oil discharge lines not only remain protected against exposure to surrounding air flows, but also remain separate and isolated from one another until reaching the cyclonic chamber. In other examples, the oil pathways may combine before reaching the cyclonic chamber.

INDUSTRIAL APPLICABILITY

In operation and use, as an engine operates, blow-by gases may develop in the crankcase 120. The blow-by gases may be drawn out of, or may otherwise flow out of, the crankcase 120 to into a crankcase ventilation system 102. The blow-by gases may be received by the ventilation system 102 in an inlet line 122, which may carry the gases to an air inlet 138 of an oil separator such as a boost assist impactor 124. The air inlet 138 of the boost assist impactor may be configured to direct the air along an inside surface of a cylindrical and/or conical wall of a cyclonic chamber 130. In one or more examples, the air at the inlet may be received into a jacket within the cyclonic chamber, where the jacket is offset from the inner surface of the cyclonic chamber to create an oil return flow gap. The cyclonic motion of the air within the jacket may separate particulate oil or free oil from the air based on centripetal forces on the oil that are higher than the forces on the air. The air may then be drawn upward into a variable geometry impactor 132. The air may flow through an intake funnel into a chute 154 where it may be directed radially outward through orifices 158 in the sidewall 156 of the chute 154. The radially directed air may pass through the orifices 158 in the sidewall 156 and across a gap 198 where it may impact media 200 supported by an impact skirt 196 surrounding the chute 154. The impact may cause aerosolized oil or remaining oil particles or free oil to be captured by the media. Having impacted the media, the air may return downward through a pathway 202 between the chute wall 156 and the impact media 200. The air may return down through the pathway 202 and out underneath the impact skirt 196 where it may be diffused further radially outward before being turned upward through a deck 184 of the VGI 132. During this process of air flow through the VGI 132, ambient air pressure and internal air pressure within the BAI may oppose one another and act on a flexible diaphragm 170 to control the position of the piston 162. Due to the dependency of the flexible diaphragm motion on the motion of the piston, the piston motion may control the amount of orifice area available in a top portion of the chute 154 based on how much area is covered by the flexible diaphragm. Depending on the type of BAI provided, the air may flow further upward and through a filter media 134 or the air may flow further upward into a secondary VGI 132. In either case, the air may then flow to an air outlet 140 where it is carried by a return line 126 to the surrounding atmosphere or back to the intake of the engine. In particular, the air may be reintroduced between the air filter and the turbocharger of the engine.

During the above process, air pressures within the BAI 124 may be controlled and/or affected by a boost air stream. That is, boost air may be received from the turbocharger system of the engine and received by the BAI at a boost air inlet 144. The boost air inlet 144 may include a nozzle that increases the velocity of the boost air across and within a top of the BAI 124 to the air outlet 140 of the BAI 124. This high velocity air may create a venturi effect on the BAI 124 and may help to offset pressure losses across one or more of the VGI's 132 or the filter media 134 such that air flow through the BAI 124 may be maintained.

Having captured the oil in the one or more channels 160 surrounding the VGI 132 and/or the media filter 134, the oil may be discharged. This process may include receiving a boost air stream into a siphoning nozzle 212 near the oil collection channel 160 and drawing the oil out of the channel 160 through a siphon tube 216. The siphon tube 216 may carry the oil to a discharge tube 214. The discharge tube 214 may extend to the cyclonic chamber 130 where the oil may be discharged between an inner surface of the cyclonic chamber 130 and a jacket 220 within the cyclonic chamber 130. The discharge tube 214 may transport the oil in isolated fashion. That is, the discharge tube 214 may be closed off against exposure to blow-by airflows within the BAI and, instead, may extend to the cyclonic chamber 130 without interruption and/or without exposure to blow-by airflows. To the extent the fluid flow is interrupted between collection from the trough 160 and discharge to the cyclonic chamber 130, it may be within an additional discharge line 214, but may remain isolated from exposure to blow-by air flow. In some examples, each discharge line 214 may be a dedicated discharge line that carries the oil to the cyclonic chamber 130 without any interruption at all, for example, where separate discharge lines 214 are provided for each oil collection channel and each discharge line extends independently to the cyclonic chamber 130 without interaction with other discharge lines 214.

The above detailed description is intended to be illustrative, and not restrictive. The scope of the disclosure should, therefore, be determined with references to the appended claims, along with the full scope of equivalents to which such claims are entitled.

What is claimed is:

1. A boost assist impactor for a crankcase ventilation system, the boost assist impactor comprising:

a blow-by air inlet;

an oil separation device including at least one of a variable geometry impactor or a filter media, the oil separation device in fluid communication with the blow-by air inlet to receive blow by air and configured to process the blow-by air to separate oil from the blow-by air;

an oil collection trough configured to collect oil from the oil separation device;

a boost air supply line configured for receiving boost air from a turbo boost system of an engine;

a nozzle in fluid communication with the boost air supply line and configured to increase the velocity of the boost air received from the boost air supply line;

a discharge tube configured to receive boost air from the nozzle at the increased velocity; and a siphon tube having an open end arranged in the oil collection trough and another end in fluid communication with the discharge tube such that the boost air in the discharge tube at the increased velocity draws oil out of the collection trough, through the siphon tube, and into the discharge tube, wherein, the discharge tube carries the oil from the oil collection trough to an oil outlet of the boost assist impactor while being fully closed off to exposure to blow-by air flow within the boost assist impactor.

2. The boost assist impactor of claim 1, wherein the oil collection trough is a first oil collection trough, the boost assist impactor further comprising a second oil collection trough.

3. The boost assist impactor of claim 2, wherein the discharge tube is a first discharge tube, the boost assist impactor further comprising a second discharge tube configured to discharge oil from the second oil collection trough.

4. The boost assist impactor of claim 3, wherein the second discharge tube carries oil from the second oil collection trough to the oil outlet in isolation from the oil in the first discharge tube.

5. The boost assist impactor of claim 3, wherein the second discharge tube receives oil from the first discharge tube in sealed fashion and delivers the oil from the first collection trough and the second collection trough to the oil outlet.

6. The boost assist impactor of claim 1, wherein the oil separation device comprises variable geometry impactor.

7. The boost assist impactor of claim 6, wherein the variable geometry impactor comprises a chute wall defining a chute and having a plurality of orifices extending therethrough.

8. The boost assist impactor of claim 7, further comprising a diaphragm deck defining a pressure pocket with an open bottom and a flexible diaphragm extending across the open bottom.

9. The boost assist impactor of claim 8, wherein the flexible diaphragm is secured to a bottom side of the diaphragm deck and comprises a downward extending fold configured to interface with the plurality of orifices to control an amount of area of the orifices that is exposed to blow-by air flowing through the boost assist impactor.

10. The boost assist impactor of claim 7, further comprising an impact skirt surrounding the chute wall.

11. The boost assist impactor of claim 10, wherein the impact skirt is sized to define a gap between the outer surface of the chute wall and the impact skirt.

12. The boost assist impactor of claim 11, further comprising impact media arranged on the impact skirt and within the gap.

13. The boost assist impactor of claim 12, wherein the impact media has a thickness smaller than the gap and defining a fluid pathway between the impact media and the outer wall of the chute.

14. The boost assist impactor of claim 7, further comprising a dome-shaped baffle arranged below the chute and the oil collection trough comprises a surrounding channel arranged on a bottom perimeter of the dome-shaped channel.

15. The boost assist impactor of claim 1, further comprising a cyclonic chamber arranged between the blow-by air inlet and the oil separation device.

16. An oil discharge system for a boost assist impactor, comprising:

an oil collection trough arranged about a variable geometry impactor or a media filter of the boost assist impactor;

a boost air supply line configured for receiving boost air from a turbo boost system of an engine;

a nozzle in fluid communication with the boost air supply line and configured to increase the velocity of the boost air received from the boost air supply line;

a discharge tube configured to receive boost air from the nozzle at the increased velocity; and a siphon tube having an open end arranged in the oil collection trough and another end in fluid communication with the discharge tube such that the boost air in the discharge tube at the increased velocity draws oil out of the collection trough, through the siphon tube, and into the discharge tube, wherein, the discharge tube isolates the oil from exposure to blow-by air flow within the boost assist impactor and carries the oil from the oil collection trough to a discharge point at or near an oil outlet of the boost assist impactor.

17. The oil discharge system of claim 16, further comprising an isolation jacket configured for arrangement in a cyclonic chamber of the boost assist impactor and further configured to protect the discharge oil from exposure to the cyclonic action within the cyclonic chamber.

18. The oil discharge system of claim 16, wherein the oil collection trough is a first oil collection trough and the oil discharge system further comprises a second oil collection trough and the discharge tube is a first discharge tube and the oil discharge system further comprises a second discharge tube configured to discharge oil from the second oil collection trough.

19. The oil discharge system of claim 18, wherein the second discharge tube carries oil from the second oil collection trough to the discharge point in isolation from the oil in the first discharge tube.

20. The oil discharge system of claim 18, wherein the second discharge tube receives oil from the first discharge tube in sealed fashion and delivers the oil from the first collection trough and the second collection trough to the discharge point.

* * * * *